US005499583A

United States Patent [19]

Blümel

[11] Patent Number: 5,499,583

[45] Date of Patent: Mar. 19, 1996

[54] RAILWAY SWITCH

[75] Inventor: Gottfried Blümel, Odelzhausen, Germany

[73] Assignee: Magnetbahn GmbH, Starnberg, Germany

[21] Appl. No.: 358,164

[22] Filed: Dec. 16, 1994

[30] Foreign Application Priority Data

Dec. 18, 1993 [DE] Germany ..... 43 43 395.5

[51] Int. Cl.[6] ..... E01B 26/00; E01B 25/12

[52] U.S. Cl. ..... 104/130.03; 104/130.05

[58] Field of Search ..... 104/130.01, 130.02, 104/130.03, 130.05, 130.06; 246/415 R

[56] References Cited

U.S. PATENT DOCUMENTS

| | | | |
|---|---|---|---|
| 3,313,243 | 4/1967 | Lauber | 104/130.05 X |
| 3,670,659 | 6/1972 | Schurch | 104/130.05 X |
| 3,782,291 | 1/1974 | Maison | 104/130.05 |
| 5,094,172 | 3/1992 | Kummer | 104/130.03 |

*Primary Examiner*—Robert J. Oberleitner
*Assistant Examiner*—Kevin D. Rutherford
*Attorney, Agent, or Firm*—Spencer & Frank

[57] ABSTRACT

A railway switch has a rightward switch position for coupling a track with a right track and a leftward switch position for coupling the track with a left track. Each track has a right rail and a left rail. The switch has a first or right rail of the rightward switch position, a second or left rail of the rightward switch position, a third or right rail of the leftward switch position and a fourth or left rail of the leftward switch position. The switch includes a turning segment whose carrier member supports the second and third rails and is rotatable through 90°. The first and fourth rails are shiftably supported by respective switch tongues. The turning segment and the switch tongues are each movable into first and second positions. In the first position the first and second rails are in an operative state and the third and fourth rails are in a withdrawn, inoperative state, whereas in the second position the third and fourth rails are in an operative state and the first and second rails are in a withdrawn, inoperative state.

9 Claims, 5 Drawing Sheets

RAILWAY SWITCH

CROSS REFERENCE TO RELATED APPLICATION

This application claims the priority of German Application No. P 43 43 395.2 filed Dec. 18, 1993, which is incorporated herein by reference.

BACKGROUND OF THE INVENTION

This invention relates to a railway switch for track-guided vehicles having a linear motor drive. The switch, dependent upon the switch position, connects a track with a left or with a right track. Each track has a right rail and a left rail; the right and left rails of the switch are exchanged upon repositioning of the switch.

A switch of the above-outlined type is disclosed, for example, in German Offenlegungsschrift (application published without examination) 38 33 904. In the switch disclosed therein those rails which are not active in a desired switch position are pivoted away downwardly from the plane of the upper surface of the rails. It is a disadvantage of such a construction that dependent upon the position of the switch, the stators are not covered by the upper side of the rails and thus are directly exposed to the effects of weather and they thus tend to corrode to a significant degree. Further, in certain applications, laterally underneath the stators exposed conductors are positioned to supply the vehicles with electric current. Such conductors too, are exposed to the effects of weather and thus moisture or icing may lead to short circuits.

SUMMARY OF THE INVENTION

It is an object of the invention to provide an improved railway switch of the above-outlined type in which the stators and any current rails are better protected from the effects of weather.

This object and others to become apparent as the specification progresses, are accomplished by the invention, according to which, briefly stated, the railway switch has a rightward switch position for coupling a track with a right track and a leftward switch position for coupling the track with a left track. Each track has a right rail and a left rail. The switch has a first or right rail of the rightward switch position, a second or left rail of the rightward switch position, a third or right rail of the leftward switch position and a fourth or left rail of the leftward switch position. The switch includes a turning segment whose carrier member supports the second and third rails and is rotatable through 90°. The first and fourth rails are shiftably supported by respective switch tongues. The turning segment and the switch tongues are each movable into first and second positions. In the first position the first and second rails are in an operative state and the third and fourth rails are in a withdrawn, inoperative state, whereas in the second position the third and fourth rails are in an operative state and the first and second rails are in a withdrawn, inoperative state.

The railway switch is designed for a rail track for vehicles driven by a linear motor (magnetic levitation or "maglev" trains). The track has a right rail and a left rail. Each rail has a vertical surface for lateral guide rollers, a horizontal surface for vertical guide rollers and a longitudinal stator. The right and left rails are in mirror symmetry to one another with respect to a central longitudinal vertical plane. In identifying "right" or "left" rails or switching positions, the reference view point is from that end of the switch where the two branch tracks join and the direction of view is toward the divergence of the switch branches. The term "rightward switch position" means that the track is connected with the right track behind the switch and, conversely, the term "leftward switch position" means that the track is connected with the left track behind the switch. It is immaterial whether only one or both switch positions describe an arc. Thus, for example, in case of a switch with a straight branch track and a leftward curving branch track, the rails in the rightward switch position are straight in plan view, whereas the rails in the leftward switch position are curved. In case of a switch with a straight track and a rightward curving branch, the rails in the leftward switch position are straight (as viewed from above) and the rails in the rightward switch position are curved.

It is further feasible to construct the switch according to the invention such that it has a leftward curving track and a curved branch towards the right or conversely. It is to be noted that in such a construction the turning segments have a more complex design.

DESCRIPTION OF THE PREFERRED EMBODIMENT

Figure 1:
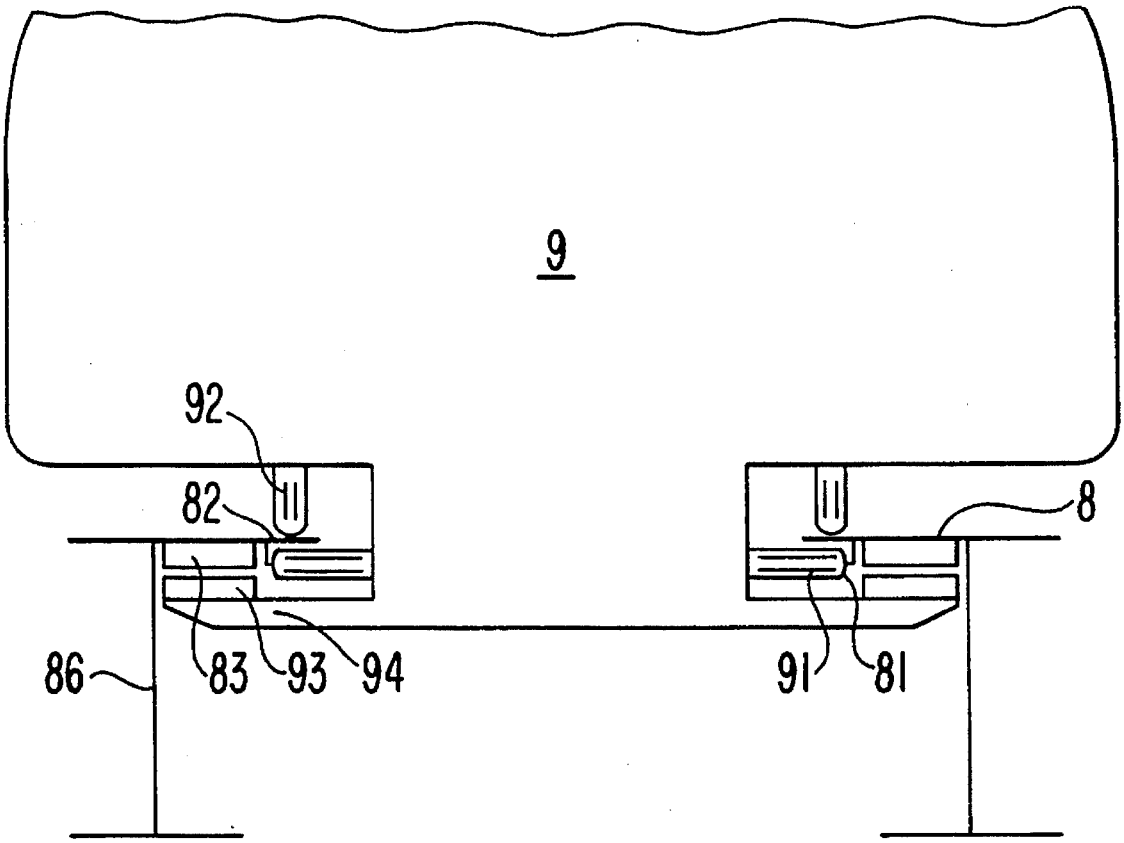
FIG. 1 (PRIOR ART)
FIG. 1 is a schematic end elevational view of a track and a track-guided vehicle having a linear motor drive.

Turning to FIG. 1, there is shown a track formed of rails 8, each including a lateral guide rail 81 and a horizontal guide rail 82 secured to the inside of the rail structure. Each rail 8 carries a stator 83 secured to carrier 86 at right angles. The carrier 86 also supports the guide rails 81 and 82. The vehicle 9 has lateral guide rollers 91, vertical guide rollers 92, permanent magnets 93 and magnet carriers 94. The longitudinal stators 83 drive the vehicle in cooperation with the permanent magnets 93 and at least partially carry the vehicle. The lateral guide rollers 91 are guided by the lateral guide rails 81, while the vertical guide rollers 92 roll on the horizontal guide rails 82 and, if required, supply an additional carrying force.

Figure 2:
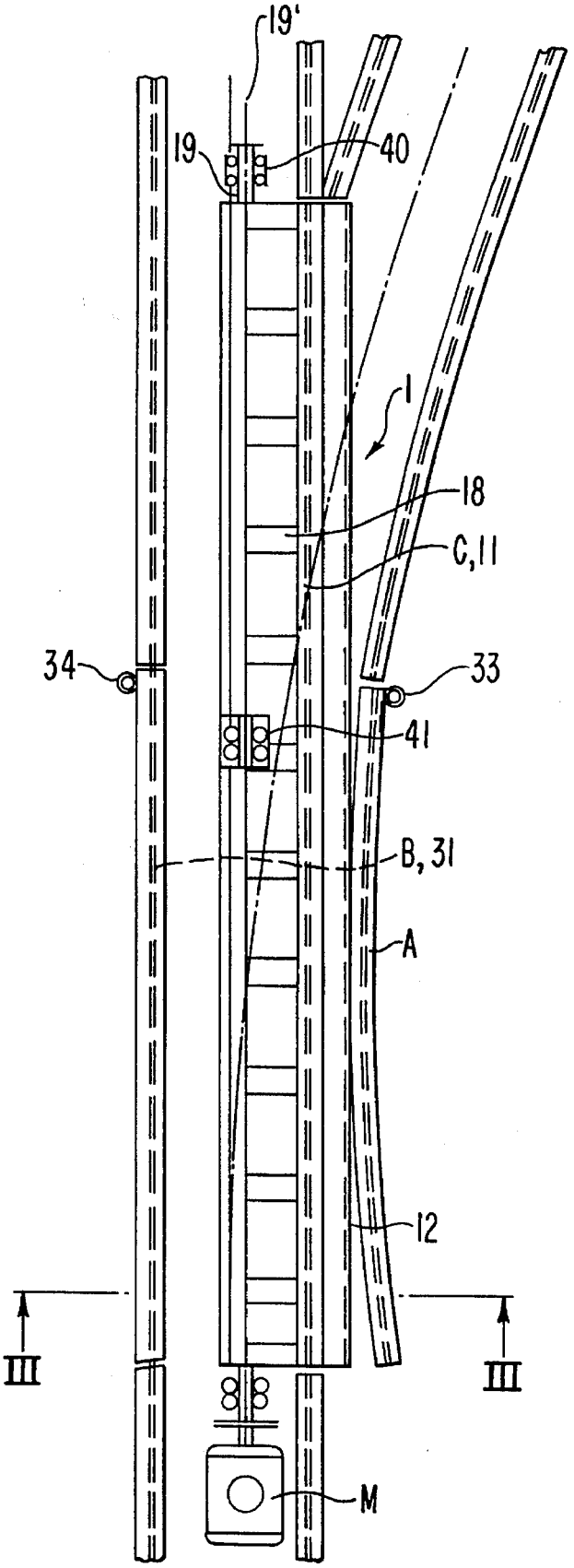
FIG. 2 is a schematic top plan view of a preferred embodiment of the invention set in a switch position for straight travel (leftward switch position).

FIG. 2 shows a preferred embodiment of the invention in the leftward switch position for straight travel as well as the adjoining tracks. The switch according to the invention includes a turning segment 1, a left switch tongue B and a right switch tongue A. The turning segment 1 includes the right rail 11 of the leftward switch position and the left rail 12 of the rightward switch position. In the illustrated embodiment the right rail 11 of the leftward switch position is the straight rail C. The left rail 12 of the rightward switch position is, along with its outer, longitudinal edge, attached at a right angle to the right rail 11 of the leftward switch position along an outer, longitudinal edge of the rail 11. The turning segment 1 is supported by means of bearings 40 and also preferably by means of one or more intermediate bearings 41. The left switch tongue B carries the left rail 31 of the leftward switch position and the rotary bearing 34, whereas the right switch tongue A carries the right rail 32 of the rightward switch position as well as the rotary bearing 33. To ensure collision-free displacements the exact position of the bearing 40, the intermediate bearing 41 and the rotary bearings 33 and 34 have to be determined as a function of the contour of the track as well as the switch radius. The track guidance in the switch position for straight travel is effected by the left rail 31 of the leftward switch position and the right rail 11 of the leftward switch position. The electromotor M effects, with the intermediary of a gearing, the turning motion of the turning segment 1 about axis 19' of an axle 19.

Figure 3:
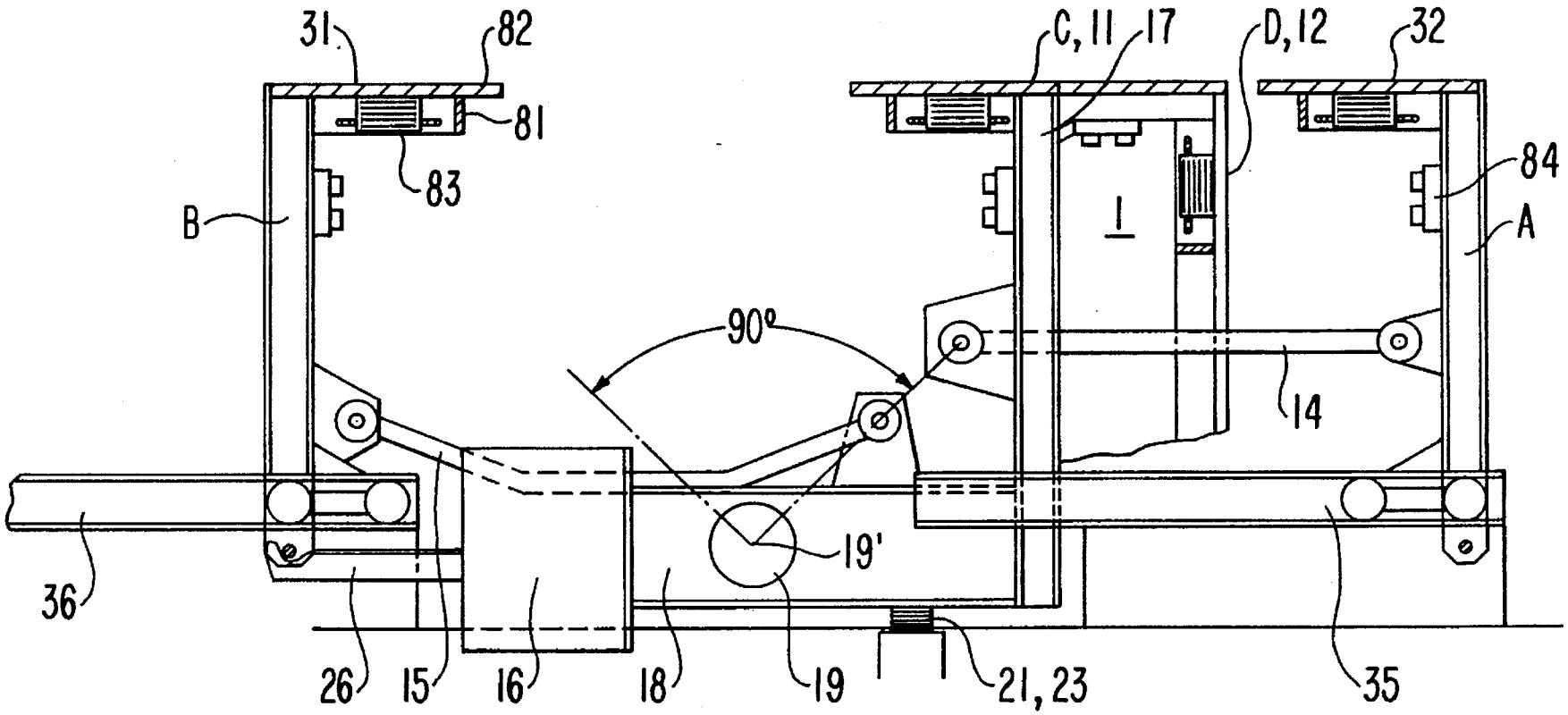
FIG. 3 is a sectional view taken along line III—III of FIG. 2.

As seen in FIG. 3, the turning segment 1 has a turning beam 18, a rail carrier 17, a straight rail C and a curved rail D. The turning beam 18 is rotatably supported by the axle 19. One end of the rail carrier 17 is attached to one end of the turning beam 18. On the other end of the rail carrier 17 the rail C is affixed which in the described embodiment is the right rail 11 of the leftward switch position. To the outer longitudinal edge of the straight rail C there is affixed at a right angle the outer longitudinal edge of the curved rail D which in the described embodiment is the left rail 12 of the rightward switch position. A counterweight 16 is attached to that end of the turning beam 18 which is remote from the location of attachment of the rail carrier 17. The turning beam 18 is coupled by means of connecting rods 14 and 15 in such a manner with the switch tongues A and B that the latter, upon rotation of the turning segment 1, are shifted from the one end position into the other end position to assume the momentarily desired switch position. In FIG. 3 the switch tongue B is shown shifted inwardly, whereas the switch tongue A is shown shifted outwardly. The switch tongues A, B are preferably guided in the linear guides 35, 36. A lock 26 is advantageously mounted on the turning segment 1 in such a manner that after the turning motion of the turning segment 1 it blocks the switch tongue B in its inwardly shifted position. In such a switch position for straight travel the turning beam 18 expediently lies on the support 21 which carries a lock 23. The rails of the turning element 1 and the switch tongues A and B have the usual rail portions as shown in FIG. 1, that is, the lateral guide rails 81, the vertical guide rails 82 and stators 83. In case the vehicle 9 is to be supplied with electricity, for example, for purposes of lighting or air conditioning, there are provided current-carrying rails 84 in the switch, laterally underneath the stators 83.

Figure 4:
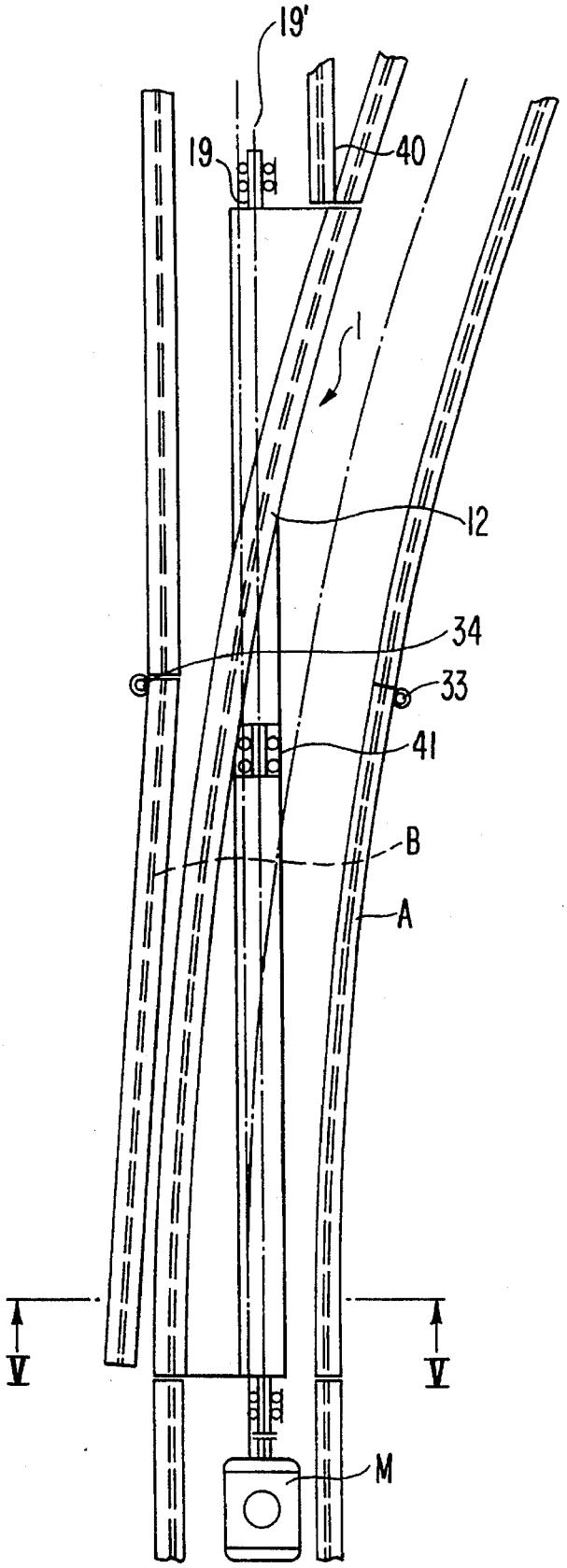
FIG. 4 is a view similar to FIG. 2 illustrating a switch position for rightward curved travel (rightward switch position).

FIG. 4 shows the switch of FIG. 2 in the rightward switch position for curved travel. In the FIG. 4 position the turning segment 1 has been rotated relative to the FIG. 2 position through 90° about the axis 19' so that the left rail 12 of the rightward switch position takes over the left track guidance whereas the right rail 32 of the rightward switch position of the switch tongue A takes over the right track guidance. In this position the switch tongue B is in its outwardly shifted position.

Figure 5:
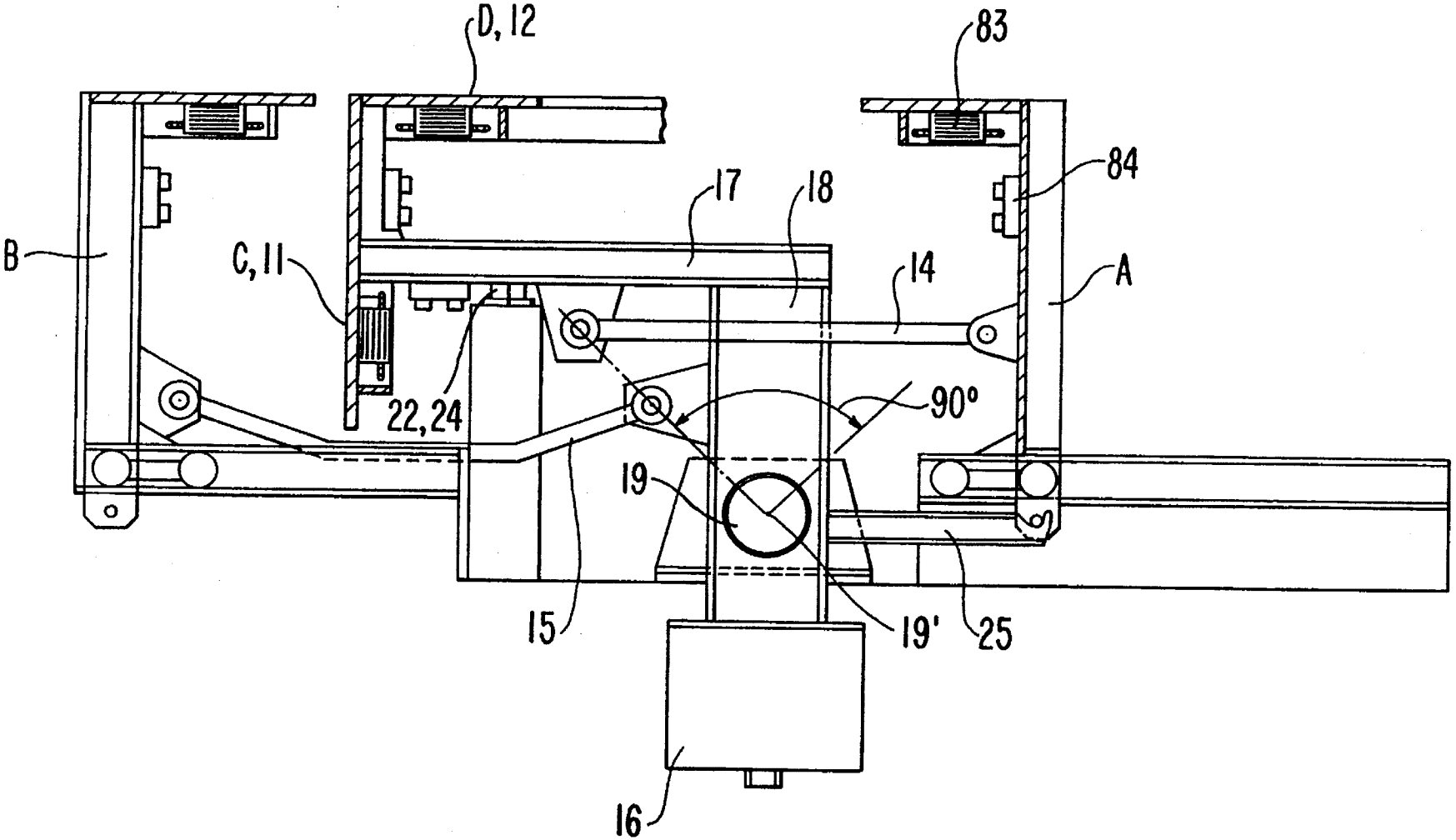
FIG. 5 is a sectional view taken along line V—V of FIG. 4.

Turning to FIG. 5, the switch tongue A has been shifted inwardly and is preferably immobilized by means of a lock 25. The latter is preferably mounted on the turning beam 18 in such a manner that after the turning motion of the turning segment 1 into its rightward switch position shown in FIG. 5, it blocks the switch tongue A in its inwardly shifted position. In this position, the turning segment 1 lies, with the rail carrier 17, on the support 22 which preferably carries a lock 24.

The above-described switch according to the invention has, as compared to the prior art switches as disclosed, for example, in the earlier-noted German Offenlegungsschrift 38 33 904, a better track guidance of the vehicles since the lateral guide rails 81 and the horizontal guide rails 82 cover the entire switch region and the switch tongues A, B may be better associated with the track path than the individual turning segments of the prior art construction. By means of coupling the turning segment 1 and the switch tongues A, B there are obtained overall simpler motions since only the turning segment 1 has to be rotated through 90°.

It will be understood that the above description of the present invention is susceptible to various modifications, changes and adaptations, and the same are intended to be comprehended within the meaning and range of equivalents of the appended claims.

What is claimed is:

1. In a railway switch for a railway track guiding and supporting vehicles propelled by a linear motor; the switch having a rightward switch position for coupling a track with a right track and a leftward switch position for coupling the track with a left track; each track having a right rail and a left rail; and said switch having a first or right rail of the rightward switch position, a second or left rail of the rightward switch position, a third or right rail of the leftward switch position and a fourth or left rail of the leftward switch position; the improvement comprising (a) a turning segment including (1) a movable carrier member;

(2) said second rail carried by the carrier member for moving therewith as a unit;

(3) said third rail carried by the carrier member for moving therewith as a unit; and (4) bearing means for rotatably supporting said carrier member;

(b) a first switch tongue for shiftably supporting said first rail;

(c) a second switch tongue for shiftably supporting said fourth rail; and (d) means for rotating said turning segment through substantially 90° into first and second positions and means for shifting said first and second switch tongues into first and second positions; in said first position of said turning segment and said first and second switch tongues, said switch assuming said rightward switch position in which said first and second rails are in an operative state and said third and fourth rails are in a withdrawn, inoperative state; and in said second position of said turning segment and said first and second switch tongues, said switch assuming said leftward switch position in which said third and fourth rails are in an operative state and said first and second rails are in a withdrawn, inoperative state.

2. The railway switch as defined in claim 1, wherein said second and third rails each has an external longitudinal edge as viewed in respective said operative states thereof; said second and third rails being affixed to one another along said external longitudinal edge thereof at right angles to one another; further wherein said carrier member comprises (a) a rail carrier having first and second ends; one of said second and third rails being affixed to said first end of said rail carrier; and (b) a turning beam supported by said bearing means; said second end of said rail carrier being affixed to an end of said turning beam and being oriented perpendicularly thereto.

3. The railway switch as defined in claim 2, wherein said one of said second and third rails is said third rail.

4. The railway switch as defined in claim 2, further comprising stationary backup supports; said turning beam lying on said stationary backup supports in said first and second positions of said turning segment.

5. The railway switch as defined in claim 2, wherein said end of said turning beam is a first end; said turning beam having a second end; said turning beam being supported by said bearing means at a location situated between said first and second ends; further comprising a counterweight attached to said second end.

6. The railway switch as defined in claim 1, further comprising releasable locking means for locking said turning segment and said first and second switch tongues in the operative states thereof.

7. The railway switch as defined in claim 6, wherein said locking means include monitoring means.

8. The railway switch as defined in claim 1, wherein said means for shifting said first and second switch tongues includes coupling means connecting said turning segment to said first and second switch tongues for effecting a shifting motion of said first and fourth rails simultaneously with a rotary motion of said carrier member; said coupling means including connecting rods.

9. The railway switch as defined in claim 1, wherein said means for rotating said turning segment comprises an electric motor.

* * * * *